US006810563B1

(12) United States Patent
Domenig et al.

(10) Patent No.: US 6,810,563 B1
(45) Date of Patent: Nov. 2, 2004

(54) MOUNTING PLATE FOR A FURNITURE HINGE

(75) Inventors: Georg Domenig, Kernersville, NC (US); Manfred Peer, Walkertown, NC (US)

(73) Assignee: Grass America Inc., Kernersville, NC (US)

( * ) Notice: Subject to any disclaimer, the term of this patent is extended or adjusted under 35 U.S.C. 154(b) by 138 days.

(21) Appl. No.: 10/287,284

(22) Filed: Nov. 4, 2002

(51) Int. Cl.[7] ..... E05D 5/00

(52) U.S. Cl. ..... 16/387; 16/382; 16/252; 16/236

(58) Field of Search ..... 16/252, 238, 242, 16/246, 235–237, 382, 387, 366, 365

(56) References Cited

U.S. PATENT DOCUMENTS

| | | | | |
|---|---|---|---|---|
| 4,506,409 A | | 3/1985 | Lautenschlager | |
| 4,716,622 A | | 1/1988 | DeBruyn | |
| 5,036,565 A | | 8/1991 | Salice | |
| 5,392,493 A | | 2/1995 | Youngdale | |
| 5,454,144 A | * | 10/1995 | Rupprechter | 16/382 |
| 5,511,287 A | | 4/1996 | Lautenschlager et al. | |
| 5,604,956 A | | 2/1997 | Grass | |
| 5,737,804 A | | 4/1998 | Ferrari et al. | |
| 5,819,371 A | * | 10/1998 | Rock et al. | 16/258 |
| 5,826,305 A | | 10/1998 | Domenig et al. | |
| 5,839,164 A | * | 11/1998 | Cress et al. | 16/383 |
| 5,887,316 A | | 3/1999 | Ferrari et al. | |
| 5,920,958 A | | 7/1999 | Domenig et al. | |
| 5,930,866 A | | 8/1999 | Rupprechter | |
| 6,049,946 A | | 4/2000 | Cress et al. | |
| 6,125,508 A | | 10/2000 | Formenti | |
| 6,125,510 A | * | 10/2000 | Domenig | 16/382 |
| 6,167,590 B1 | | 1/2001 | Domenig | |
| 6,170,121 B1 | | 1/2001 | Domenig | |
| 6,240,599 B1 | | 6/2001 | Peer et al. | |
| 6,470,531 B2 | | 10/2002 | Domenig et al. | |
| 6,523,225 B1 | * | 2/2003 | Pecar | 16/382 |

FOREIGN PATENT DOCUMENTS

CA 2264218 A1 * 9/1999

* cited by examiner

*Primary Examiner*—Chuck Y. Mah
(74) *Attorney, Agent, or Firm*—John M. Harrington; Kilpatrick Stockton LLP

(57) ABSTRACT

A mounting plate for a furniture hinge includes a hinge plate pivotably connected to a hinge component, such as a hinge cup, on a pivot axis. At least one front support members depends from the front edge of the hinge plate and is spaced a predetermined radial distance from the pivot axis. The front support member depends a distance from the hinge plate that is less than, and preferably not greater than three-fourths, the predetermined radial distance between the front support member and the pivot axis. The mounting plate also includes at least one opposing rear support member depending from the rear edge of the hinge plate a distance that is at least as great as, and preferably, at least one and three-fourths times, the distance by which the front support member depends from the hinge plate. At least one fastener opening is formed in one or both of the hinge plate and the at least one rear support member, and the front and rear support members are adapted to confront opposing sides of a cabinet member on which the mounting plate is installed and cooperatively provide subjacent lateral support for the cabinet member when a fastener received through the fastener opening is inserted into the cabinet member.

14 Claims, 8 Drawing Sheets

MOUNTING PLATE FOR A FURNITURE HINGE

FIELD OF THE INVENTION

The present invention relates generally to furniture hinges, and more particularly, to a mounting plate for mounting a hinge on a furniture article, such as a desk of cabinet, which in turn supports a door on the furniture article.

BACKGROUND OF THE INVENTION

In the cabinetry industry, a typical construction feature, for example, in cabinets which are provided with doors, is a face frame on which the door is supported and hinged. The face frame members are affixed, for example, to an opening in the cabinet, and a pair of concealed hinges are affixed to an edge one of the face frame members and the door. Typically, the face frame member to which the hinges are affixed is made of a relatively strong material, such as hardwood, and has a thickness in the range, for example of about one-half inch up to about three-fourths inch. A customary mounting method of affixing the concealed hinge to the face frame member utilizes a hinge mounting plate which is positioned on an edge of the face frame member and fastened to the face frame member with one or more fasteners, such as fastening screws, inserted through one or more openings in the mounting plate and into, for example, one or more corresponding pre-drilled holes in the face frame member. Alternatively, the face frame may be omitted entirely, for example, in frameless cabinets, and the hinge plate may be affixed directly to an edge of a cabinet wall member in a substantially similar way.

The customary method of affixing concealed hinges works well, for example, on cabinet components made of relatively strong materials, such as hardwood. However, serious problems are encountered when attempts are made to employ the customary method of affixing concealed hinges, for example, to less expensive materials, which are not as strong as hardwood. One such material is a panel product manufactured from lignocellulosic fibers combined with a synthetic resin or other suitable binder, commonly known as medium density fiberboard (MDF). MDF panels thinner than one-half inch are typically used, for example, for siding, and most of the thicker MDF panels (one-half to three-fourths inch) have generally been used as core materials for furniture panels. In recent years, however, use of finished MDF panels, for example, in cabinetry has become common in the manufactured or mobile home industry.

Attempts to employ the customary method of affixing concealed hinges in cabinetry by the manufactured home or mobile home industry, where MDF is now in relatively common use has met with mixed results. Reasons for the lack of success in the manufactured home or mobile home industry include, for example, that when fasteners such as fastening screws are used at or near an edge of a MDF cabinet panel component, such as a face frame member, which ranges in thickness from about one-half inch to about five-eighths inch up to about three-fourths inch, the pre-drilling of a fastener hole in the panel and/or inserting the fastener in the fastener hole tends to cause the panel component to weaken or split, so that in any event there is little or no resistance to withdrawal of the fastener from the fastener hole. Thus, the fastener tends to pull out of the cabinet component under the weight of the door supported by the hinge.

SUMMARY OF THE INVENTION

It is a feature and advantage of the present invention to provide a furniture hinge for a mounting plate which is inexpensive to make, easy to use, and which enables use, for example, of concealed, edge-mounted type hinges on relatively weak cabinet components, such as MDF panels.

To achieve the stated and other features, advantages and objects of the present invention, an embodiment of the present invention provides a mounting plate for a furniture hinge which includes, for example, a hinge plate with front and rear opposing edges which is pivotably connected to a hinge component, such as a hinge cup, on a pivot axis or pivot pin. At least one front support member depends from the front edge of the hinge plate that is spaced a predetermined radial distance from the pivot axis. The distance by which the front support member depends from the hinge plate is determined by the predetermined radial distance between the front support member and the pivot axis on which the hinge plate is pivotably connected to the hinge component. In an embodiment of the invention, the front support member depends a distance from the hinge plate that less than the predetermined radial distance between the front support member and the pivot axis, and preferably a distance that is not greater than three-fourths of the predetermined radial distance between the front support member and the pivot axis. Alternatively, the at least one front support member comprises a pair of front support legs depending from the front edge of the hinge plate.

In addition, according to an embodiment of the invention, at least one opposing rear support member depends from the rear edge of the hinge plate a distance that is at least as great as the distance by which the front support member depends from the hinge plate, and preferably the rear support member depends from the rear edge of the hinge plate a distance that is at least one and three-fourths times the distance by which the front support member depends from the hinge plate. Further, at least one fastener opening is formed in either or both of the hinge plate and the at least one rear support member, and the front and rear support members are adapted to confront opposing sides of a cabinet member on which the mounting plate is installed and to cooperatively provide subjacent lateral support for the cabinet member when a fastener received through the fastener opening is inserted into the cabinet member.

In an alternate embodiment, the at least one opposing rear support member comprises a pair of rear support legs depending from the rear edge of the hinge plate with a fastener opening formed in each of the rear support legs. Further, the fastener opening formed in each of the rear support legs can be open to a distal edge of the respective support legs. Instead of, or in addition to, having fastener openings formed in the rear support legs, one or more fastener openings can be formed in the hinge plate, and the fastener opening or openings formed in the hinge plate can have an elongate shape.

In the foregoing embodiments, the hinge plate has a hinge arm formed on its front edge that is pivotably connected to the hinge component on the pivot axis via a hinge pin. However, an alternate embodiment includes a multiple adjustment aspect in which the hinge plate is connected to the hinge component via an intermediate member slideably connected to the hinge plate, and a hinge arm member is pivotably connected to the intermediate member via a pivot pin and also pivotably connected to the hinge component on the pivot axis via a hinge pin. In this aspect, the intermediate member is slideably connected to the hinge plate via a pair of L-shaped bent projections on the hinge plate that form a channel slideably receiving the intermediate member and an eccentric screw received through an elongate aperture formed in the intermediate member and into an aperture formed in the hinge plate. Thus, turning the cam screw causes the intermediate member and the hinge arm member connected to the intermediate member via the pivot pin to move relative to the hinge plate slideably in the channel formed between the L-shaped bent projections on the hinge plate.

Further, in the multiple adjustment aspect, the hinge arm member is pivotably connected to the intermediate member on a pivot axis via a pin fastened through the hinge arm member and the intermediate member and an adjustment screw received through apertures formed in the hinge arm member and in the intermediate member. Thus, turning the adjustment screw causes the hinge arm member to move relative to the intermediate member arcuately about the pivot pin connecting the hinge arm member to the intermediate member.

Additional objects, advantages and novel features of the present invention will be set forth in part in the description which follows, and in part with become more apparent to those skilled in the art upon examination of the following or may be learned by practice of the invention.

DETAILED DESCRIPTION

Figure 1:
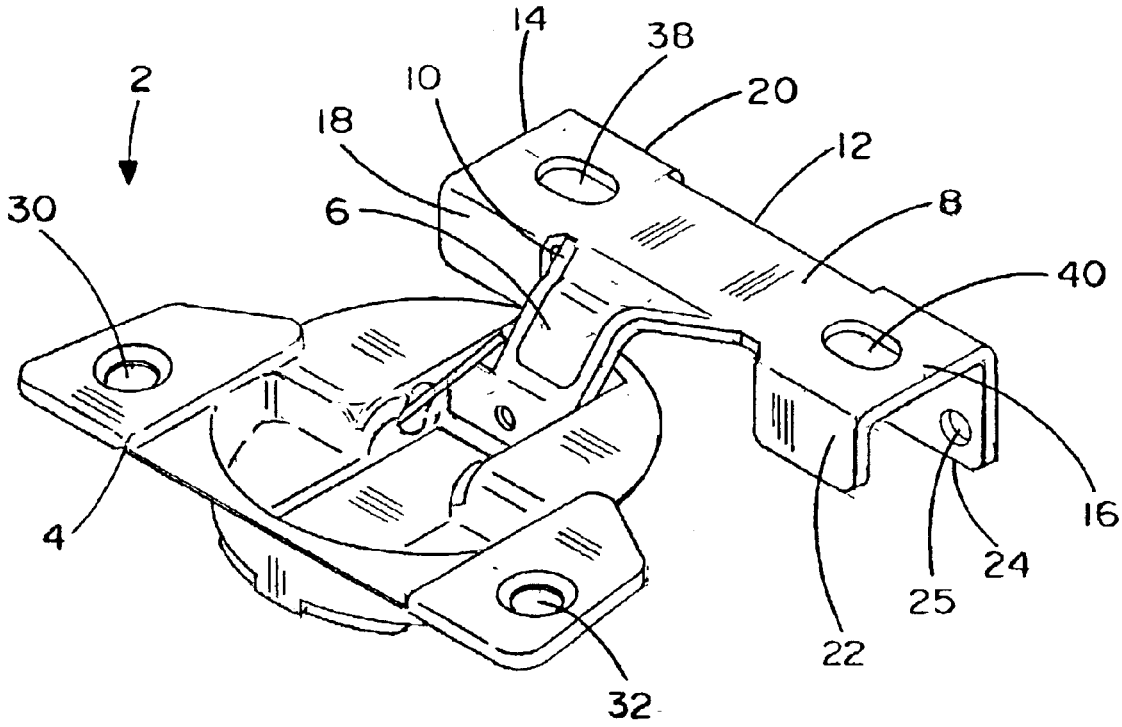
FIG. 1 shows a perspective view of an example of a hinge for an embodiment of the present invention.

Referring now in detail to an embodiment of the present invention, an example, of which is illustrated in the accompanying drawings, FIG. 1 shows a perspective view of the hinge 2 for an embodiment of the present invention. The hinge 2 includes a hinge cup 4 which is mountable, for example, in a recess of a cabinet door and a hinge arm 6, which is pivotably connected to the hinge cup 4. The hinge arm 6 extends from a hinge plate 8, which is mountable on a cabinet component, such as a face frame member. The hinge plate 8 is generally rectangular in shape with opposing front and rear edges 10 and 12 and opposing ends 14 and 16. A first pair of opposing legs 18 and 20 depend from opposing front an rear edges 10 and 12 respectively at or near one of the opposing ends 14, and a second pair of opposing legs 22 and 24 extend from front and rear opposing edges 10 and 12 respectively at or near the other of the opposing ends 16.

Figure 2:
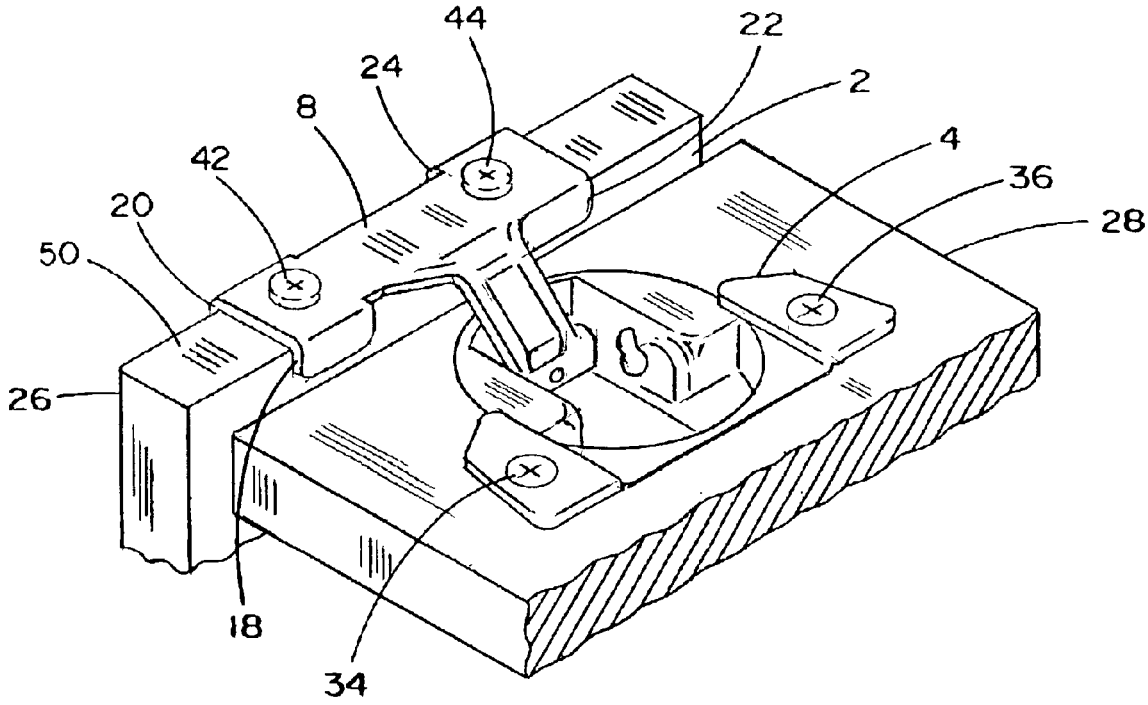
FIG. 2 shows a perspective view of the hinge of FIG. 1 mounted on a cabinet component, such as a face frame member and a cabinet door for an embodiment of the present invention.
Figure 3:
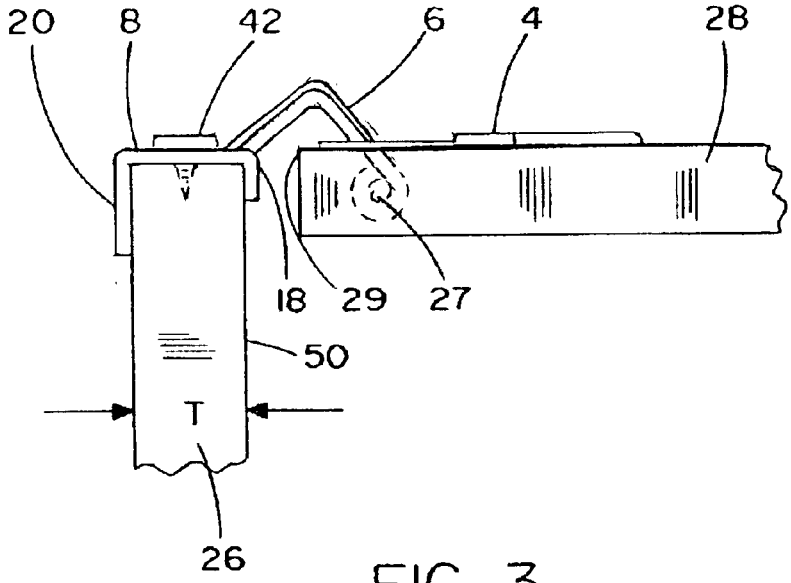
FIG. 3 is a side view of the hinge plate of the hinge of FIGS. 1 and 2 mounted on the face frame member for an embodiment of the present invention.

FIG. 2 shows a perspective view of hinge 2 of FIG. 1 mounted on a cabinet component, such as a face frame member 26 and a cabinet door 28 for an embodiment of the present invention. FIG. 3 is a side view of the hinge plate 8 of hinge 2 mounted on the face frame member 26 for an embodiment of the present invention. As shown in FIG. 1, the hinge cup 4 is provided with openings 30 and 32 for receiving fasteners, such as fastening screws 34 and 36, as shown in FIG. 2, for affixing the hinge cup to cabinet door 28. The hinge plate 8 is provided with openings 38 and 40 for receiving fasteners, such as fastening screws 42 and 44, as shown in FIG. 2, for affixing the hinge plate to the cabinet component, such as face frame member 26. In addition, or as an alternative, the rear legs 20 and 24 of hinge plate 8 can each be provided with an opening for receiving a fastener, such as opening 25 formed in rear leg 24, as shown in FIG. 1.

In an embodiment of the invention, opposing front and rear legs 18 and 20 are each perpendicular to hinge plate 8 and parallel to one another, and opposing front and rear legs 22 and 24 are likewise each perpendicular to hinge plate 8 and parallel to one another. Further, opposing front and rear legs 18 and 20 are spaced apart from one another by a distance that is substantially equal to a thickness "T" of cabinet member 26, as shown in FIG. 3, and front and rear opposing legs 22 and 24 are likewise spaced apart from one another by a distance that is likewise substantially equal to the thickness "T" of cabinet member 26.

A reason for such parallel relationship and spacing of the respective pairs of front and rear opposing legs 18, 20 and 22, 24 is that when fastening screws 42 and 44 are inserted through openings 38 and 40 and, for example, into pre-drilled openings in an edge portion of cabinet member 26, front and rear opposing legs 18, 20 and front and rear opposing legs 22, 24, respectively, rest against the opposite surfaces of cabinet component 26 adjacent the edge portion in confronting relationship with the opposite surfaces and cooperate with one another to provide lateral subjacent support against splitting of the edge portion as fastening screws 42 and 44 are tightened.

It is self-apparent that when hinge plate 8 is installed on the cabinet member 26, such as a face frame member, the front legs 18 and 22 overlap the outer face 50 of the face frame member by the length of the front legs as can be seen from FIG. 3. The hinge cup 4 is installed in the back side of the cabinet door 28 as near as possible to the inside edge 29 of the cabinet door, and when the cabinet door is closed, the cabinet door 28 typically overlaps the face frame member 26 on the hinge side by about one-half inch and thus hides about one-half inch of the edge portion of the face frame member. Esthetically, it is preferable that the front legs 18 and 22 mounted on the edge portion of the face frame member 26 are not exposed to view when the cabinet door 28 is closed. Thus, in an embodiment of the present invention, in order to assure that the front legs 18 and 22 do not show when the cabinet door 28 is closed, the front legs 18 and 22 extend no further than absolutely necessary to provide lateral support, for example, to keep the MDF from splitting when the fasteners 42, 44 are tightened. It has been found that for this purpose an optimum length for the front legs 18 and 22 is about one-fourth inch, and more particularly, the maximum length for the front legs 18 and 22 is five-sixteenths inch.

Further, when the cabinet door 28 is moved, for example, from an open to a closed position, the inside edge 29 of the door swings in an arc about a pivot axis 27 on a turn radius that must clear the front legs 18 and 22 in order to close. It has been found that in order to be able to freely open and close the cabinet door 28 for an embodiment of the present invention, the front legs 18 and 22 must depend from the hinge plate 8 a distance which is not greater than about three-fourths of the distance between the front faces of the front legs 18 and 22 and the pivot axis 27 on which the hinge arm 6 is pivoted in the hinge cup 4. Typically, the distance between the front faces of the front legs 18, 22 and the pivot axis 27 is approximately seven-sixteenths inch. Thus, the front legs 18 and 22 for an embodiment of the invention do not depend further than about five-sixteenths inch from the hinge plate 8. At the same time, it has been found that such a distance is adequate to provide sufficient lateral support to avoid splitting the edge portion of the MDF cabinet component 26 when fasteners 42, 44 are tightened.

In order to cooperatively provide the support necessary to prevent such splitting of the edge portion of cabinet component 26, the rear legs 20 and 24, respectively, for an embodiment of the invention must depend a distance from hinge plate 8 that is at least as great as the distance by which front legs 18 and 22 depend from hinge plate 8. On the other hand, in order to minimize cost, the rear legs 20 and 24 for an embodiment of the invention likewise extend no further than absolutely necessary to provide such lateral support. It has been found that when the front legs 18 and 22 depend from the hinge plate 8 no further than about three-fourths the distance between the front faces of the front legs 18 and 22 and the pivot axis 27, the rear legs 20 and 24 for an embodiment of the invention preferably depend a distance from hinge plate 8 that is at least one and three-fourths times the distance by which the front legs 18 and 22 depend from hinge plate 8 in order to provide sufficient lateral support to prevent splitting of the edge portion of the cabinet component 26. For example, in an embodiment of the invention, when the distance between the front aces of the front legs 18 and 22 and the pivot axis 27 is approximately seven-sixteenths inch, the front legs 18 and 22 depend about five-sixteenths inch from the hinge plate 8, and the rear legs 20 and 24 depend about nine-sixteenths inch from the hinge plate 8.

In an embodiment of the present invention, as the front and rear opposing legs 18 and 20 and the front and rear opposing legs 22 and 24 furnish support against splitting cabinet component 26 when fasteners 42, 44 are received in the edge portion of the cabinet component, it is advantageous to position fastener openings 38 in hinge plate 8 substantially between front and rear opposing legs 18 and 20 and to likewise position fastener opening 40 in hinge plate 8 substantially between front and rear opposing legs 22 and 24. In order to accommodate a moderate degree of adjustment of the door 28 after it is mounted to the cabinet component 26 on hinge 2, the fastener openings 38 and 40 in hinge plate 8 can be slightly elongated as shown in FIG. 1. Thus, after inserting fastening screws 42 and 44 into the edge portion of cabinet component 26, the position of door 28 can be adjusted in a vertical direction relative to cabinet component 26 by loosening fastening screws 42 and 44.

Figure 4:
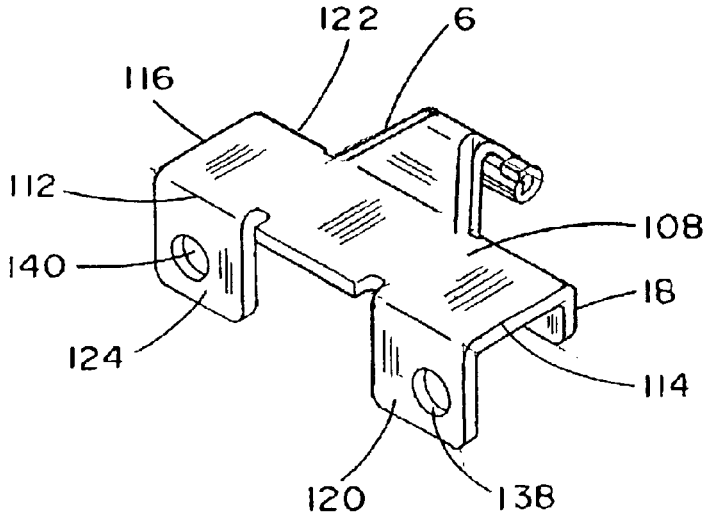
FIG. 4 shows a rear perspective view of an example of a hinge plate for an alternative embodiment of the present invention in which fastener openings are disposed in rear legs of the hinge plate.
Figure 5:
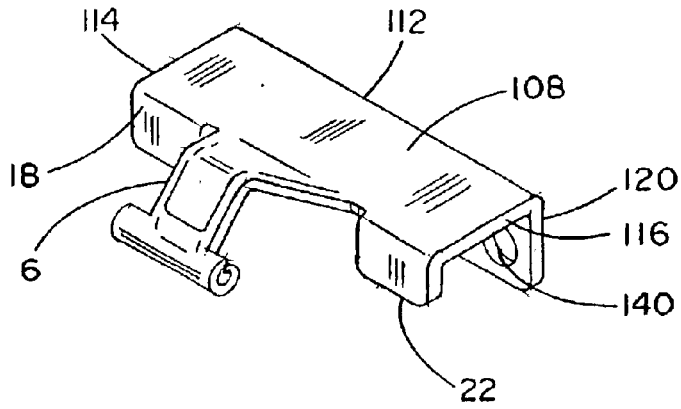
FIG. 5 shows a front perspective view of the hinge plate of FIG. 4.
Figure 6:
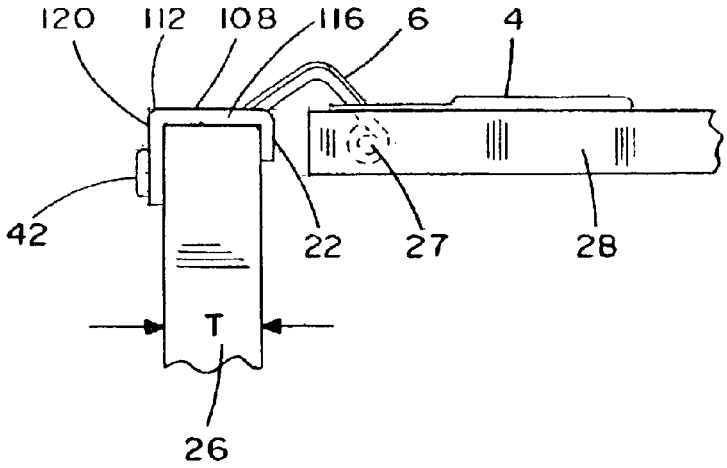
FIG. 6 shows a side view of the hinge plate of FIG. 4 mounted on a face frame member.

FIG. 4 shows a rear perspective view of a hinge plate 108 for an alternative embodiment of the present invention in which fastener openings 138 and 140 are disposed in rear legs 120 and 124, respectively. FIG. 5 shows a front perspective view of the hinge plate of FIG. 4, and FIG. 6 shows a side view of the hinge plate of FIG. 4 mounted on the face frame member 26. Referring to FIGS. 4–6, hinge arm 6 extends from hinge plate 108 which is mountable on face frame member 26. Hinge plate 108 has opposing front and rear edges 110 and 112 and opposing ends 114 and 116. Rear legs 120 and 124 depend from rear edge 112, and front legs 18 and 22 depend from front edge 110, of hinge plate 108. Rear legs 120 and 124 extend from rear edge 112, for example, at or near opposing ends 114 and 116, respectively, and front legs 18 and 22 depend from front edge 110 at or near opposing ends 114 and 116, respectively. .

As shown in FIG. 4, rear legs 120 and 124 are provided with openings 138 and 140 respectively for receiving fasteners, such as fastening screw 142 shown in FIG. 6, for affixing the rear legs 120 and 124 depending from hinge plate 108 to face frame member 26. Thus, in use, hinge cup 4 is affixed to cabinet door 28, and hinge plate 108 is positioned on an edge portion of face frame member 26 with rear legs 120 and 124 confronting a surface portion of face frame member 26 adjacent the edge portion of the face frame member. With hinge plate 108 and rear legs 120, 124 so positioned, fasteners, such fastening screw 42 can be inserted in openings 138 and 140 and screwed into surface portions of face frame member 26 proximate the edge portion of the face frame member 26.

This arrangement of inserting the fastening screws 42 in surface portions rather than an edge portion of face frame member 26, for an embodiment of the present invention, takes advantage of a known characteristic of MDF, which is generally denser and stronger at or near the surface than toward the center. In other words, the fastening screws 42 are less likely to pull out of the MDF material under the weight of the door 28 on the hinge if screwed into surface portions rather than an edge portion of the face frame member 26. In order to take further advantage of this known characteristic, and to assure inserting the fastening screws 42 as far as possible away from edge portion of the face frame member 26, fastener openings 138 and 140 are disposed in rear legs 120 and 124 as near as possible to distal edges of rear legs 120 and 124 and as far away as possible from rear edge 1 12 of hinge plate 108.

In the embodiment shown in FIGS. 4–6, front legs 18 and 22 likewise depend from the hinge plate 108 no further than about three-fourths the distance between the front faces of front legs 18 and 22 the pivot axis 27, and the rear legs 120 and 124 likewise depend a distance from hinge plate 108 that is at least as great as and preferably at least one and three-fourths times the distance by which the front legs 18 and 22 depend from hinge plate 108 in order to cooperatively provide sufficient lateral support for the edge portion of the MDF cabinet component 26 to avoid splitting the MDF cabinet component when the fasteners 42 are tightened. Likewise, in this embodiment, when the distance between the front faces of front legs 18 and 22 and pivot axis 27 is approximately seven-sixteenths inch, the front legs 18 and 22 depend up to about five-sixteenths inch from the hinge plate 108, and the rear legs 120 and 124 depend at least about nine-sixteenths inch from the hinge plate 108.

Figure 7:
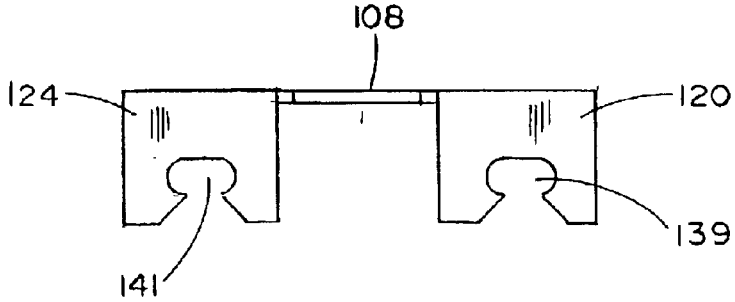
FIG. 7 shows an elevational view of the rear legs of the hinge plate of FIG. 4 with alternate embodiment fastener openings which are open to a distal edge of the rear legs of the hinge plate.

Referring further to FIGS. 4–6, rear legs 120 and 124 are substantially perpendicular to hinge plate 108, and substantially parallel to front legs 18 and 20, respectively. Further, rear legs 120 and 124 are spaced apart from front legs 18 and 22, respectively, by a distance that is substantially equal to the thickness "T" of face frame member 26. Likewise, referring to FIGS. 4–6, in order to accommodate a moderate degree of adjustment of the door 28 after it is mounted to the cabinet component 26 on the hinge, fastener openings 138 and 140 are slightly elongated. Thus, after inserting the fastening screws 42 into the surface portion of face frame member 26, the position of the door 28 can be adjusted in a vertical direction relative to the face frame member 26 by loosening the fastening screws 42. FIG. 7 shows an elevational view of the rear legs 120 and 124 with alternate embodiment fastener openings 139 and 141, each of which is open to a distal edge of rear legs 120 and 124, respectively, to enable sliding the rear legs onto fastening screws premounted in face frame member 26 and easy removal of the hinge plate 108 by simply loosening the fastening screws without removing them.

Figure 8:
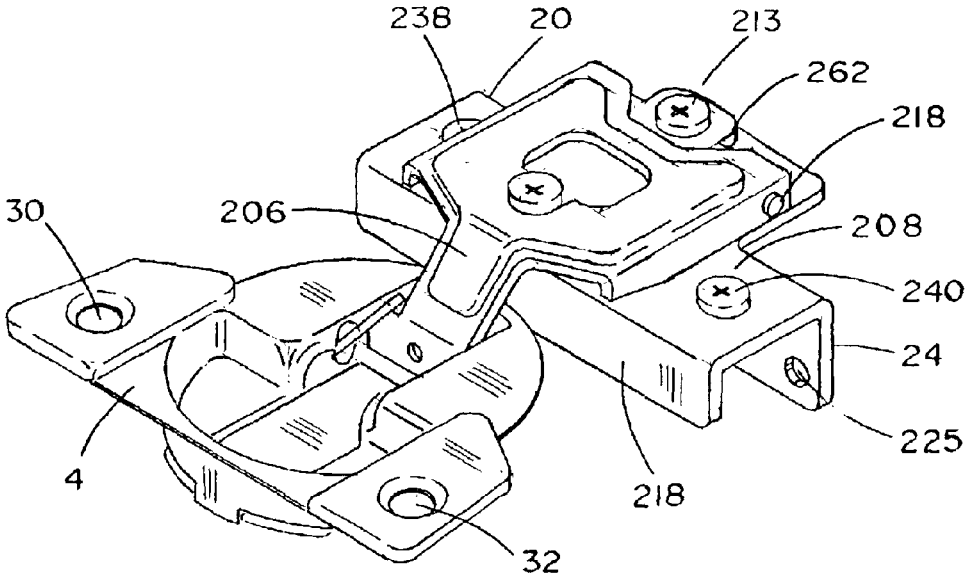
FIG. 8 shows a front perspective view of an example of a hinge plate for another alternate embodiment of the present invention, which employs a front ledge rather than a pair of front legs
Figure 12:
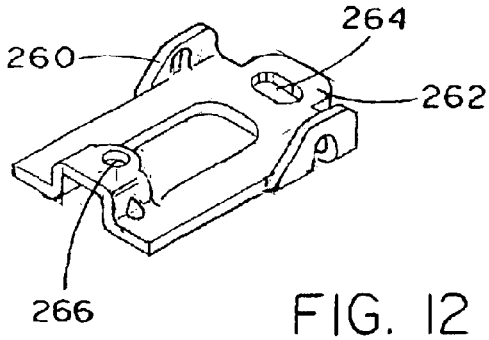
FIG. 12 is a perspective view of the intermediate plate of the hinge of FIG. 8.
Figure 13:
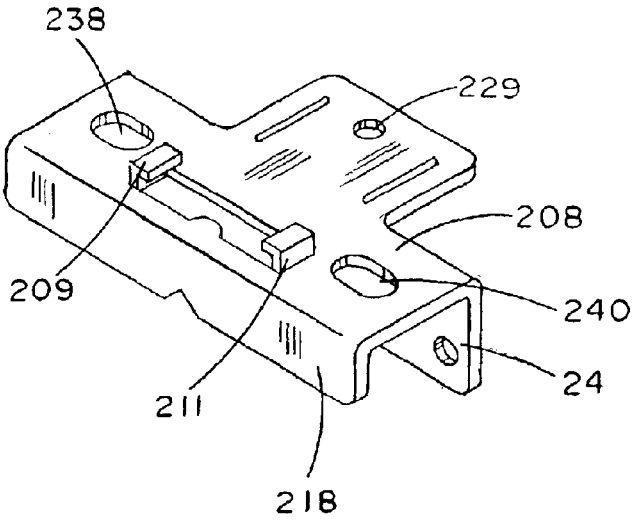
FIG. 13 is a perspective view of the hinge plate of the hinge of FIG. 8
Figure 9:
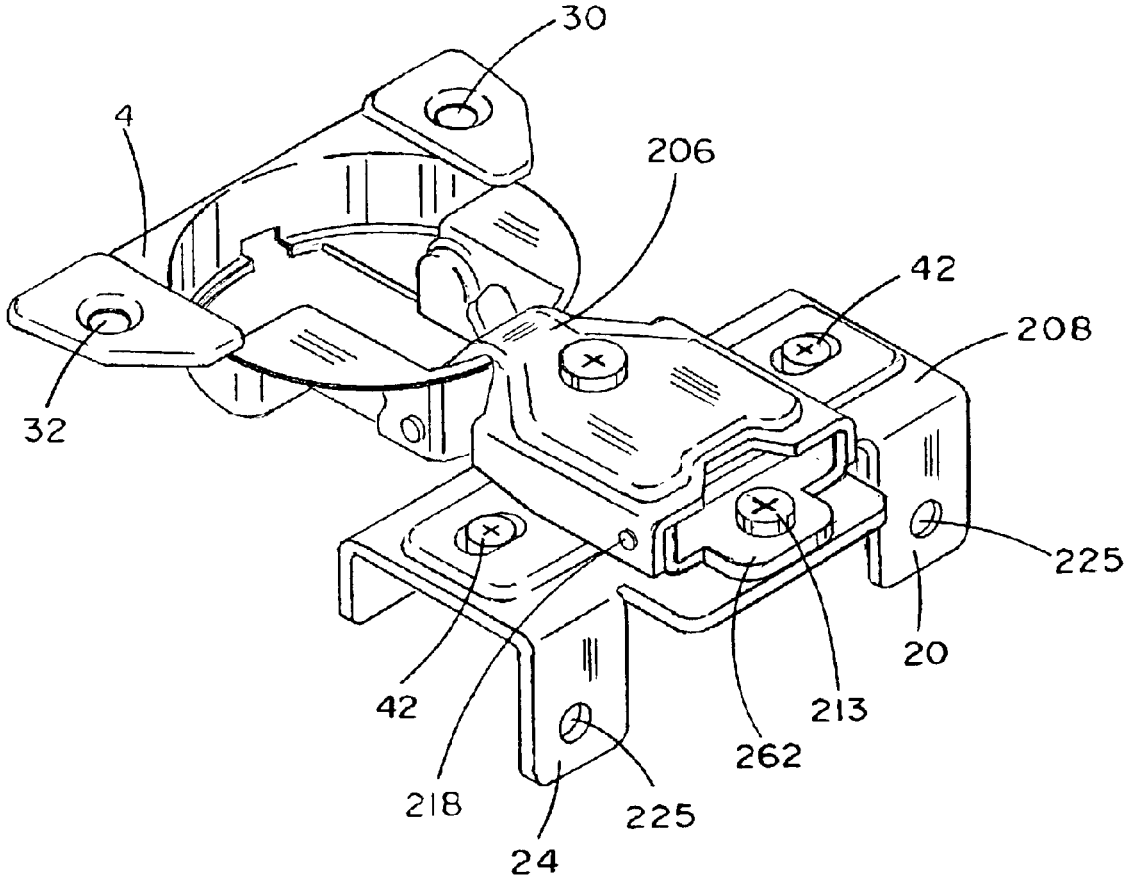
FIG. 9 shows a rear perspective view of the hinge plate of FIG. 8.
Figure 10:
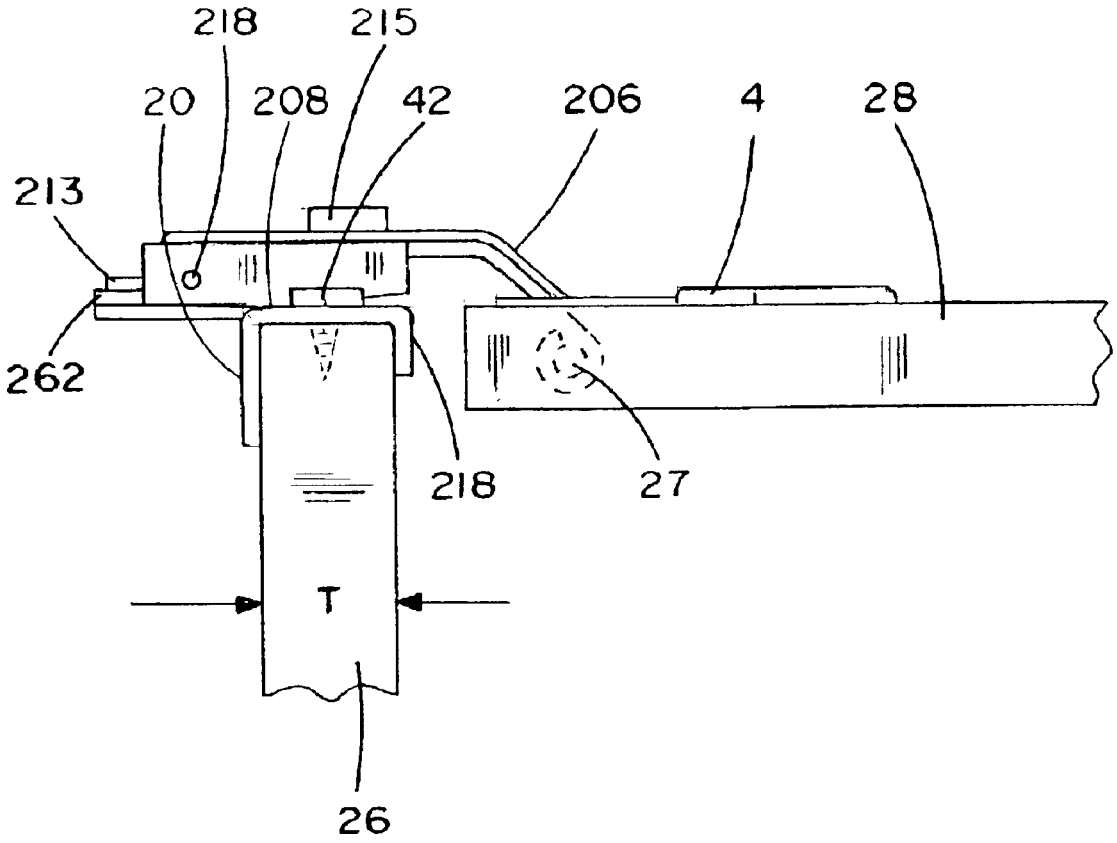
FIG. 10 shows a side view of the hinge plate of FIG. 8 mounted on a face frame member 26.
Figure 11:
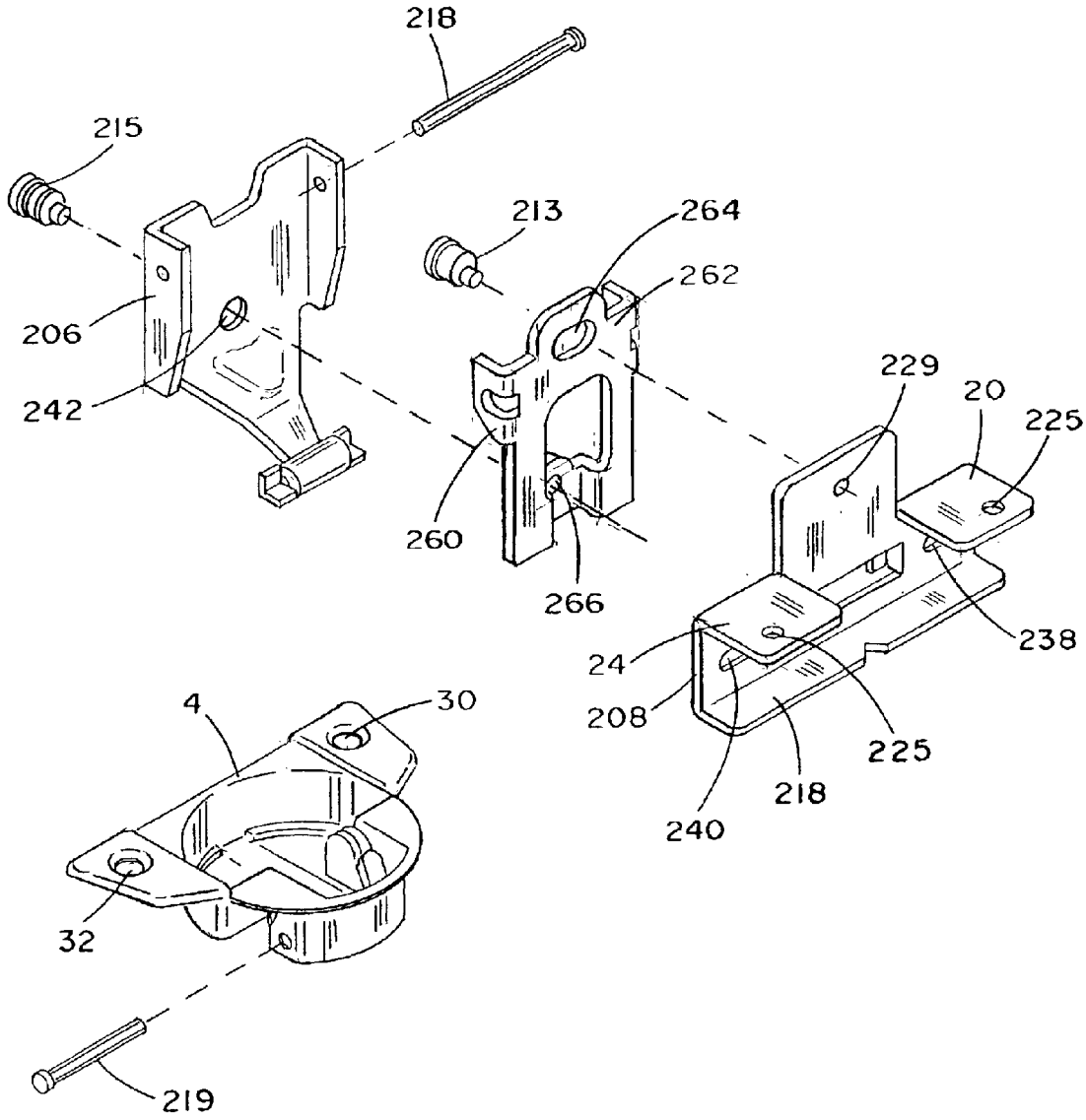
FIG. 11 shows an exploded view of the hinge of FIG. 8.

FIG. 8 shows a front perspective view of a hinge plate 208 for another alternate embodiment of the present invention, which employs a front ledge 218 rather than a pair of front legs. A reason for the use of a pair of front legs in preceding embodiments is that material disposed between the front legs is utilized to form hinge arm 6, as shown from example in FIG. 1. However, in the embodiment of FIG. 8, the hinge plate 208 and the hinge arm member 202 are separate components. Thus, in this embodiment, the front ledge 218 extends across the entire width of the hinge plate 208 to provide maximum subjacent support for the edge portion of the cabinet component 26. FIG. 9 shows a rear perspective view of the hinge plate 208 of FIG. 8, and FIG. 10 shows a side view of the hinge plate 208 of FIG. 8 mounted on the face frame member 26. Referring to FIGS. 8–10, there is shown various views of the alternate embodiment for use in a three-dimensionally adjustable hinge. FIG. 11 shows an exploded view of the hinge of FIG. 8 so that all the individual parts of the hinge can be more readily seen and understood. The hinge of FIGS. 8–11 includes a hinge cup 4, a hinge arm member 206, an intermediate member 262, and a hinge plate 208. FIG. 12 is a perspective view of the intermediate plate 262, and FIG. 13 is a perspective view of the hinge plate 206 for the embodiment of FIGS. 8–11. Hinge cup 4 is mountable flush in a bore hole in the back of a door 28 with fastening screws in a known manner, and includes a spring to facilitate automatic closing of the door. Hinge plate 208 is adapted to be affixed to the doorframe 26.

In the embodiment of FIGS. 8–13, hinge arm member 206 has a circular aperture 242 to receive an adjusting screw 215. Intermediate member 262 has an elongated aperture 264, a circular aperture 266, and a pair of bent projections 260. Hinge plate 208 is somewhat T-shaped and has a pair of elongate apertures 238 and 240 and a circular aperture 229. Hinge plate 208 is attachable to frame 26 via two fastening screws 42. Hinge arm member 206 has an arm end pivotably attached to hinge cup 4 on a pivot axis 27 via hinge pin 219. Hinge arm member 206 is also pivotably attached to intermediate member 262 on a pivot axis via pin 218 fastened through hinge arm member 206 and intermediate member 262. Intermediate member 262 is slideably connected to hinge plate 208 via a pair of L-shaped bent projections 209 and 211 on the base plate 208 that form a channel to slideably receive intermediate member 262. Intermediate member 262 is also slideably connected to base plate 208 with a cam or eccentric screw 213 via the elongated aperture 264 in the intermediate member 262 and the circular aperture 229 in the hinge plate 208. Hinge arm member 206 is also adjustably connected to intermediate member 262 via adjustment screw 215 through aperture 242 in hinge arm member 206 and aperture 266 in intermediate member 262.

Adjustment screw 215 cooperates with the circular aperture 242 in hinge arm member 206 and the circular aperture 266 in intermediate member 262 to allow limited pivotal adjustment of hinge arm member 206 relative to intermediate member 262 (i.e., side to side adjustment of door 28). When adjustment screw 215 is turned, hinge arm member 206 moves pivotably relative to intermediate member 262 on a pivot axis defined by pin 218, thereby allowing side-to-side adjustments of door 28 to be made, for example, so that the desired spacing of the door from opposite sides of the cabinet door opening can be adjusted. The cam or eccentric screw 213 is mounted in the hinge plate 208 by means of a projection inserted in circular aperture 229, and the cam or eccentric screw 213 extends through the elongated hole 264 in the intermediate member 262. When cam screw 213 is turned, intermediate member 262 and hinge arm member 206 connected to intermediate member 262 via pin 218 move relative to hinge plate 208 slideably to and fro in the channel formed between bent projections 209, 211 on hinge plate 208, so that a desired alignment of the front face of the door 28 with the front of the cabinet can be adjusted.

In the embodiment of the invention shown in FIGS. 8–13, front ledge 218 depends from the hinge plate 208 no further than about three-fourths the distance between the front face of front ledge 218 and the pivot axis 27 as shown in FIG. 10, and the rear legs 20 and 24 depend a distance from hinge plate 208 that is at least as great as and preferably at least one and three-fourths times the distance by which the front ledge 218 depends from hinge plate 208, in order to cooperatively provide sufficient lateral support for the edge portion of the MDF cabinet component 26 to avoid splitting the MDF cabinet component when the fasteners 42 are tightened. Likewise, in this embodiment, when the distance between the front face of front ledge 218 and pivot axis 27 is approximately seven-sixteenths inch, the front ledge 218 depends up to about five-sixteenths inch from the hinge plate 208, and the rear legs 20 and 24 depend not more than about nine-sixteenths inch from the hinge plate 208.

Referring further to FIGS. 8–13, rear legs 20 and 24 are substantially perpendicular to hinge plate 208, and substantially parallel to front ledge 218. Further, rear legs 20 and 24 are spaced apart from front ledge 218 by a distance that is substantially equal to the thickness "T" of face frame member 26. Likewise, referring to FIGS. 8–13, in order to accommodate a moderate degree of adjustment of the door 28 after it is mounted to the cabinet component 26 on the hinge, fastener openings 238 and 240 are slightly elongated. Thus, after inserting the fastening screws 42 into an edge portion of face frame member 26, the position of the door 28 can be adjusted in a vertical direction relative to the face frame member 26 by loosening the fastening screws 42.

In a further aspect of an embodiment of the present invention, for reasons, for example, of economy and esthetics, mounting plates 8, 108, and 208 are made of metal, such as steel, that has a thickness not greater than about one to one and two-tenths millimeters. In trials using mounting plates made from inexpensive ordinary steel of such thickness, it has been found that the mounting plates deform when force is applied, such as by tightening the fastening screws against the mounting plate, and the mounting plate simply bends, providing little or no subjacent support to the edge portion of the cabinet member 26, so that the hinge and supported door fall off the cabinet. In order to overcome this deficiency, an embodiment of the present invention includes post forming heat treatment to obtain the desired characteristics of surface hardness and rigidity of the steel mounting plate. For example, heat treating of the steel for mounting plates 8, 108, and 208 for wear involves addition of carbon, with or without nitrogen, to impart a surface layer of controlled thickness and increased hardness and rigidity and wear resistance to the mounting plate. In addition, the remaining inner core of the steel mounting plate can have its physical properties modified by heating and cooling temperatures and rates to maintain or increase strength.

Various preferred embodiments of the invention have been described in fulfillment of the various objects of the invention. It should be recognized that these embodiments are illustrative of the principles of the present invention. Numerous modifications and adaptations thereof will be readily apparent to those skilled in the art without departing from the spirit and scope of the present invention. Accordingly, the invention is limited only by the following claims.

What is claimed is:

1. A mounting plate for a furniture hinge, comprising:

a hinge plate having front and rear opposing edges and opposing ends and pivotably connected to a hinge component on a pivot axis;

at least one front support member depending from the front edge of the hinge plate and spaced a predetermined radial distance from the pivot axis, the front support member depending a distance from the hinge plate that is less than the predetermined radial distance between the front support member and the pivot axis on which the hinge plate is pivotably connected to the hinge component;

at least one opposing rear support member depending from the rear edge of the hinge plate perpendicular to the hinge plate a distance that is greater than the distance by which the front support member depends from the hinge plate;

at least one fastener opening formed in at least one of the hinge plate and the at least one rear support member; and wherein the front and rear support members are adapted to confront opposing sides of a cabinet member on which the mounting plate is installed and cooperatively provide subjacent lateral support for the cabinet member when a fastener received through the fastener opening is inserted into the cabinet member.

2. The mounting plate of claim 1, wherein the at least one front support member depends a distance from the hinge plate that is not greater than three-fourths of the predetermined radial distance between the front support member and the pivot axis on which the hinge plate is pivotably connected to the hinge component.

3. The mounting plate of claim 2, wherein the at least one front support member further comprises a pair of front support legs depending from the front edge of the hinge plate.

4. The mounting plate of claim 1, wherein the at least one opposing rear support member depends from the rear edge of the hinge plate a distance that is at least one and three-fourths times the distance by which the front support member depends from the hinge plate.

5. The mounting plate of claim 4, wherein the at least one opposing rear support member further comprises a pair of rear support legs depending from the rear edge of the hinge plate.

6. The mounting plate of claim 5, wherein the at least one fastener opening further comprises a fastener opening formed in each of the rear support legs.

7. The mounting plate of claim 6, wherein the fastener opening formed in each of the rear support legs is open to a distal edge of the respective support legs.

8. The mounting plate of claim 1, wherein the at least one fastener opening farther comprises at least one fastener opening formed in the hinge plate.

9. The mounting plate of claim 8, wherein the at least one fastener opening formed in the hinge plate has an elongate shape.

10. The mounting plate of claim 1, wherein the at least one fastener opening further comprises at least one fastener opening formed in the at least one rear support member.

11. The mounting plate of claim 10, wherein the at least one fastener opening formed in the rear support member is open to a distal edge of the rear support member.

12. A mounting plate for a furniture hinge, comprising:

a hinge plate having front and rear opposing edges and opposing ends and pivotably connected to a hinge component on a pivot axis;

at least one front support member depending from the front edge of the hinge plate and spaced a predetermined radial distance from the pivot axis, the front support member depending a distance from the hinge plate that is less than the predetermined radial distance between the front support member and the pivot axis on which the hinge plate is pivotably connected to the hinge component;

at least one opposing rear support member depending from the rear edge of the hinge plate a distance that is at least as great as the distance by which the front support member depends from the hinge plate;

at least one fastener opening formed in at least one of the hinge plate and the at least one rear support member;

wherein the front and rear support members are adapted to confront opposing sides of a cabinet member on which the mounting plate is installed and cooperatively provide subiacent lateral support for the cabinet member when a fastener received through the fastener opening is inserted into the cabinet member; and wherein the hinge plate is connected to the hinge component via an intermediate member slideably connected to the hinge plate and a hinge arm member pivotably connected to the intermediate member via a pivot pin and also pivotably connected to the hinge component on the pivot axis via a hinge pin.

13. The mounting plate of claim 12, wherein the intermediate member is slideably connected to the hinge plate via a pair of L-shaped bent projections on the hinge plate that form a channel slideably receiving the intermediate member and an eccentric screw received through an elongate aperture formed in the intermediate member and into an aperture formed in the hinge plate, and wherein turning the cam screw causes the intermediate member and the hinge arm member connected to the intermediate member via the pivot pin to move relative to the hinge plate slideably in the channel formed between the L-shaped bent projections on hinge plate.

14. The mounting plate of claim 13, wherein the hinge arm member is pivotably connected to the intermediate member on a pivot axis via a pin fastened through hinge arm member and intermediate member and an adjustment screw received through an aperture formed in the hinge arm member and an aperture formed in the intermediate member, and wherein turning the adjustment screw causes the hinge arm member to move relative to the intermediate member arcuately about the pivot pin connecting the hinge arm member to the intermediate member.

* * * * *

UNITED STATES PATENT AND TRADEMARK OFFICE

CERTIFICATE OF CORRECTION

PATENT NO. : 6,810,563 B1 
DATED : November 2, 2004
INVENTOR(S) : George Domenig and Manfred Peer It is certified that error appears in the above-identified patent and that said Letters Patent is hereby corrected as shown below:

Column 5,
Line 49, that portion reading "when the distance between the front aces of the front legs," should read -- when the distance between the front faces of the front legs --.

Column 10,
Line 2, that portion reading "fastener opening farther comprises at least" should read -- fastener opening further comprises at least --.
Line 34, that portion reading "provide subiacent lateral support" should read -- provide subjacent lateral support --.

Signed and Sealed this

Nineteenth Day of April, 2005

JON W. DUDAS
*Director of the United States Patent and Trademark Office*